US005212856A

United States Patent [19]

Di Giusto et al.

[11] Patent Number: 5,212,856

[45] Date of Patent: May 25, 1993

[54] TUNNEL SYSTEM FOR A HOT STRIP ROLLING MILL LINKED TO THE CONTINUOUS CASTING OF THIN SLABS

[75] Inventors: Bruno Di Giusto; Alessandro Dorigo, both of Udine, Italy

[73] Assignee: Danieli & C. Officine Meccaniche SpA, Buttrio, Italy

[21] Appl. No.: 832,478

[22] Filed: Feb. 7, 1992

[30] Foreign Application Priority Data

Feb. 19, 1991 [IT] Italy ..... UD91A000023
Mar. 20, 1991 [IT] Italy ..... UD91A000046

[51] Int. Cl.[5] ..... B21D 1/46; B21D 13/22; B22D 11/12

[52] U.S. Cl. ..... 29/33 C; 29/527.7; 164/417

[58] Field of Search ..... 29/33 C, 33 S, 527.6, 29/527.7; 164/476, 417

[56] References Cited

U.S. PATENT DOCUMENTS

| | | | |
|---|---|---|---|
| 3,385,579 | 5/1968 | Peck et al. . | |
| 4,918,803 | 4/1990 | Di Giusto | 29/33 C |
| 4,998,338 | 3/1991 | Seidel et al. | 28/33 C X |
| 5,014,412 | 5/1991 | Nobis et al. | 29/527.7 |
| 5,020,208 | 6/1991 | Feldmann et al. | 29/527.7 |
| 5,035,036 | 7/1912 | Bohnenkamp | 29/33 C |
| 5,075,953 | 12/1991 | Braud | 29/33 C X |
| 5,115,547 | 5/1992 | Rohde | 29/33 C |

FOREIGN PATENT DOCUMENTS

| | | | |
|---|---|---|---|
| 0240052 | 10/1987 | European Pat. Off. . | |
| 0264459 | 4/1988 | European Pat. Off. . | |
| 0309656 | 4/1989 | European Pat. Off. . | |
| 0353487 | 2/1990 | European Pat. Off. . | |
| 0413169 | 2/1991 | European Pat. Off. . | |
| 3740619 | 12/1988 | Fed. Rep. of Germany . | |
| 3908457 | 9/1990 | Fed. Rep. of Germany | 29/527.7 |
| 55-45530 | 3/1980 | Japan | 29/527.7 |
| 58-163505 | 9/1983 | Japan | 29/527.7 |
| 61-176402 | 8/1986 | Japan | 29/527.7 |

*Primary Examiner*—J. Reed Batten, Jr.
*Attorney, Agent, or Firm*—Antonelli, Terry, Stout & Kraus

[57] ABSTRACT

Each continuous casting line is associated with a first insulated tunnel (18) followed by a second temperature-equalization furnace tunnel (19) positioned in sequence between a continuous casting plant (11) and a rolling mill (13).

13 Claims, 2 Drawing Sheets

TUNNEL SYSTEM FOR A HOT STRIP ROLLING MILL LINKED TO THE CONTINUOUS CASTING OF THIN SLABS

BACKGROUND OF THE INVENTION

This invention concerns a tunnel system for a hot strip rolling mill linked to the continuous casting of thin slabs.

To be more exact, this invention concerns a tunnel system for the storage and temperature equalization of the slabs, the system being positioned between two twin lines for the continuous casting of thin slabs and the strip rolling line.

The present applicants are not aware of the existence of tunnel systems according to this invention.

According to the invention a first insulated tunnel is included downstream of each of two lines for the continuous casting of thin slabs. Slabs of a slender thickness coming from the respective continuous casting line arrive in this insulated tunnel after having been inspected and sheared to size.

The spirit of the invention covers processing with two casting lines in sequence in such a way as to create a desired interval, of about half the length of the thin slab for instance, between the leading end of one thin slab coming from one casting line and the leading end of another thin slab coming from the other casting line.

A temperature-equalization furnace tunnel for each continuous casting line is located between the insulated tunnels and the strip rolling train and ensures perfect equalization of the temperature of the thin slab.

The system (insulated tunnels and temperature-equalization tunnel), in the event of stoppages of the strip rolling train, enables a stock to be built up consisting of a number of slabs equal to the quantity of liquid steel contained in the ladle.

Each chamber of the insulated tunnels contains a determined number of powered roller conveyors positioned one above another and borne on a framework capable of vertical movement so that the roller conveyors can be aligned with the respective upstream roller conveyor of the casting line and with the respective downstream roller conveyor of the temperature-equalization furnace tunnel.

These storage roller conveyors are advantageously positioned above the working roller conveyor.

The two temperature-equalization furnace tunnels consist substantially of one single body containing two independent side-by-side chambers, one per each casting line, within which are included powered rollers that feed the thin slab towards the rolling mill.

Suitable burners positioned above and possibly also below the thin slab and divided into temperature-adjustment zones ensure perfect equalization of the temperature of the thin slab during its movement of feed.

Both the side-by-side chambers can move transversely to enable their axes to be aligned alternately with the axis of the rolling mill.

Under normal working conditions the thin slabs coming from the two continuous casting lines pass into their respective insulated tunnels, then into the chambers of the temperature-equalization furnace tunnels and thence alternately into the hot strip rolling mill.

When a slab is positioned in its respective temperature-equalization tunnel, the invention includes the possibility of halting the slab for enough time for every part of the slab to have the required temperature in a uniform manner. Such halting of the slab enables the heating and temperature-equalization curve to be checked accurately.

If ever it is necessary to halt the rolling mill, it is possible to build up a stock of a number of thin slabs corresponding to the weight of the steel held in the ladle and to arrange these slabs on appropriate tiers of rollers in the insulated tunnels, these tiers descending in sequence until storage has been completed.

When the rolling mill starts up again, the thin slabs are fed forwards from the roller conveyors of the insulated tunnels to the chambers of the temperature-equalization furnace tunnels until the two insulated tunnels have resumed their intial condition.

When it is necessary to feed cold, stored, thin slabs to the rolling mill, according to a variant the invention comprises a heating furnace, which raises the temperature of the slabs to about 900° C. and is followed by one of the two temperature-equalization furnace tunnels, which enables the thin slab to be heated to the rolling temperature. This temperature-equalization furnace tunnel is positioned momentarily in cooperation with the outlet of the heating furnace.

According to a variant an emergency flying shears is included at the outlet of the temperature-equalization furnace tunnel and starts working by shearing the thin slab arriving, in the event of the rolling mill being obstructed.

According to a further variant a descaling assembly is provided at the inlet of the rolling mill so as to remove the scale formed on the surface of the slab during heating; the descaling assembly is followed by a vertical stand suitable to gauge the sides of the slab.

Yet another variant consists in introducing between the insulated tunnel and the temperature-equalization tunnel a further induction-heating furnace so as to create the following situation.

The insulated tunnel is able to ensure the maintaining of the temperature of the slab, the induction-heating furnace can ensure that the heating of the slab is kept homogeneous and the temperature-equalization furnace tunnel can ensure equalization of the temperature throughout the slab.

BRIEF DESCRIPTION OF THE DRAWINGS

Let us now see a preferred embodiment of the invention with the help of the attached figures, which are given as a non-restrictive example and in which.

DETAILED DESCRIPTION OF THE EMBODIMENTS

A tunnel system 10 is positioned between a continuous casting plant 11 with two lines to cast thin slabs and a strip rolling mill 13.

Figure 3:
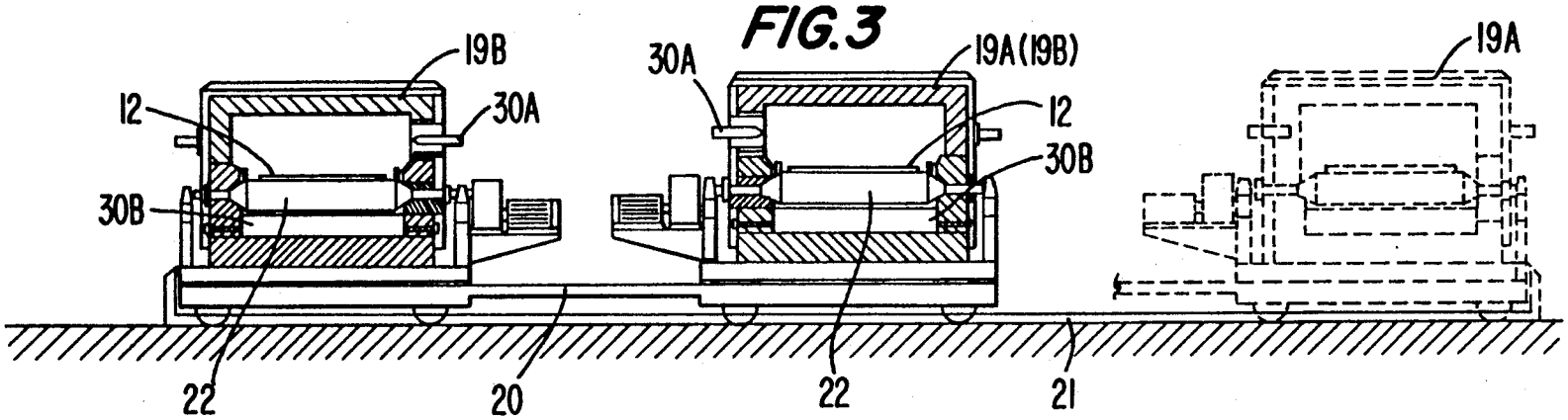
FIG. 3 shows a vertical cross section of the temperature-equalization furnace tunnels according to the invention.
Figure 1:
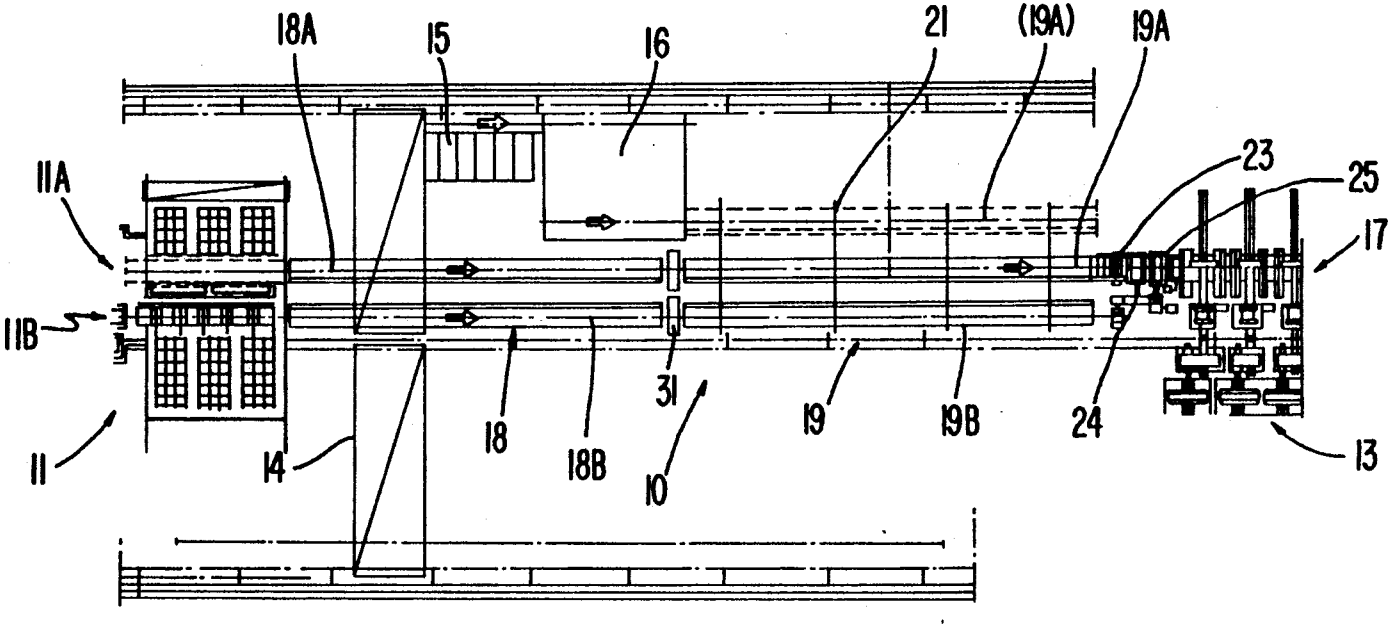
FIG. 1 is a plan view of a tunnel system of the type according to this invention.
Figure 2:
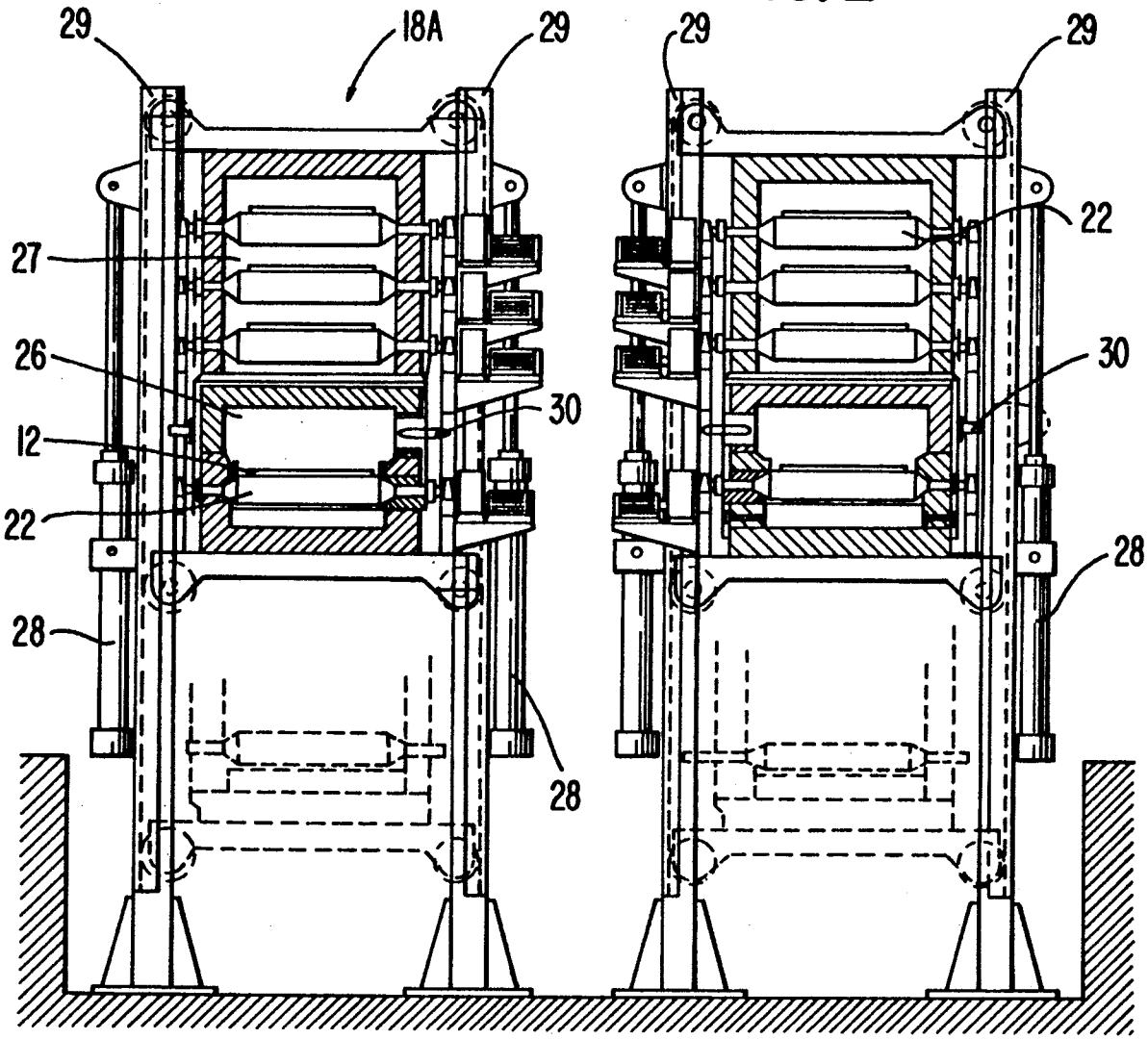
FIG. 2 is a vertical cross section of the insulated tunnels according to the invention.

FIG. 1 shows also in a diagram bridge cranes 14, a store 15 for cold thin slabs and a heating furnace 16.

The two casting lines are referenced respectively with 11A and 11B, while a rolling line is referenced with 17.

The tunnel system 10 comprises two insulated tunnels 18 positioned on the same respective axes 18A–18B as the casting lines 11A and 11B and as two respective temperature-equilization furnace tunnels 19A–19B.

In this example the two temperature-equalization furnace tunnels 19A–19B are installed on one single frame 20 capable of being moved transversely on rails 21 by actuators of a known type, so that now one 19A and now the other 19B of the temperature-equalization furnace tunnels 19 can be positioned with its axis on the same axis as the rolling line 17.

When one 19A of the temperature-equalization furnace tunnels 19 is positioned away from the rolling axis 17, this tunnel 19A cooperates with the outlet of the heating furnace 16 so that it can possibly be fed with cold thin slabs 12 taken from the store 15 and heated in the heating furnace 16.

It is possible in this way to feed the rolling line 17 also with thin slabs 12 taken from the store 15.

Powered rollers 22 are included in the temperature-equalization furnace tunnels 19 and can feed the thin slabs 12 towards the strip rolling mill 13.

A descaling assembly 23 and a vertical stand 24 to gauge the sides of the thin slabs 12 are positioned between the temperature-equalization furnace tunnels 19 and the strip rolling mill 13.

An emergency flying shears 25 is also included.

In the example shown the insulated tunnels 18 comprise a working chamber 26 and a storage chamber 27 positioned above the working chamber 26.

The working chamber 26 contains one series of powered rollers 22 to feed the thin slabs 12, whereas in this example the storage chamber 27 contains three series of powered rollers 22 to feed the thin slabs 12.

The whole assembly of the two chambers 26–27 can be moved vertically by vertical positioners 28 along guides 29.

The vertical positioners 28 can position the various tiers determined by the specific powered rollers 22 in proper coincidence with the powered rollers of the casting line and with the powered rollers of the temperature-equalization furnace tunnel 19.

The working chamber 26 is the chamber positioned in the normal working position.

When the rolling mill 13 has to be halted, the thin slabs 12 coming from the casting line 11 are stored on the various tiers consisting of the powered rollers 22 of the storage chamber 27 until the liquid metal in the ladle has been entirely used up.

When the rolling mill 13 is restarted, each tier of powered rollers 22 is repositioned in turn, and the relative powered rollers 22 feed the stored thin slabs 12 into the rolling mill 13.

The temperature-equalization furnace tunnels 19 include burners 30 working above 30A and below 30B the thin slabs 12.

The insulated tunnels 18 too comprise burners 30.

According to a variant a further induction-heating furnace 31 is introduced between the insulated tunnel 18 and the temperature-equalization furnace tunnel 19 so as to create the following situation: the insulated tunnels 18 can ensure that the temperature of the slabs is maintained, the induction-heating furnaces 31 positioned between the insulated tunnels 18 and the temperature-equalization furnace tunnels 19 can ensure that the heating of the slabs is kept homogeneous and the temperature-equalization furnace tunnels 19 can maintain equalization of the temperature throughout the slabs.

We claim:

1. A system for continuous casting of thin slabs and hot strip rolling thereof, comprising:

a continuous casting plant having at least one continuous casting line for casting of thin slabs along an axis;

at least one first insulated tunnel provided downstream of and operably connected to said at least one continuous casting line and extending longitudinally along said axis;

at least one second temperature equalization furnace tunnel provided downstream of and operably connected to said at least one first insulated tunnel, wherein said at least one second temperature equalization furnace tunnel has a first working position extending along said axis; and a rolling mill downstream of and operably connected to said at least one second temperature equalization furnace tunnel.

2. System as claimed in claim 1, further comprising an induction-heating furnace included between the at least one first insulated tunnel and the at least one second temperature-equalization furnace tunnel.

3. System as claimed in claim 1, further comprising a descaling assembly included downstream of the at least one second temperature equalization furnace tunnel and upstream of the rolling mill.

4. System as claimed in claim 1, further comprising a flying shears included downstream of the at least one second temperature equalization furnace tunnel and upstream of the rolling mill.

5. System as claimed in claim 1, further comprising a stand with vertical rolls included downstream of the at least one second temperature equalization furnace tunnel and upstream of the rolling mill.

6. System as claimed in claim 1, wherein the continuous casting plant comprises at lease two continuous casting lines, at least two first insulated tunnels and at least two second temperature-equalization furnace tunnels, wherein said at least two second temperature equalization tunnels are installed substantially side by side on a transversely movable frame which is movable to alternately position one and the other of the at least two second temperature-equalization tunnels on the same axis as that of the rolling mill.

7. System as claimed in claim 6, wherein the at least two second temperature-equalization furnace tunnels comprise burners.

8. System as claimed in claim 6, wherein the at least two first insulated tunnels comprise at least a working chamber.

9. System as claimed in claim 8, wherein the at least two first insulated tunnels further comprise a storage chamber.

10. System as claimed in claim 9, wherein the working chamber of the at least two first insulated tunnels and the at least two temperature-equalization furnace tunnels comprise powered rollers to advance thin slabs downstream.

11. System as claimed in claim 9, wherein the storage chamber comprises at least one movable storage tier of powered rollers.

12. System as claimed in claim 11, further comprising means to vertically position the at least two first insulated tunnels.

13. System as claimed in claim 6, further comprising a furnace for heating cold slabs wherein the transversely movable frame is movable so as to couple one of the at least two temperature-equalization furnace tunnels momentarily to an outlet of the furnace for heating cold slabs.

* * * * *